US012065815B2

(12) United States Patent
Stein et al.

(10) Patent No.: US 12,065,815 B2
(45) Date of Patent: Aug. 20, 2024

(54) JET REGULATOR

(71) Applicant: Neoperl GmbH, Mullheim (DE)

(72) Inventors: Alexander Stein, Ihringen (DE); Gerhard Blum, Gutach (DE); Oliver Denzler, Bottmingen (CH)

(73) Assignee: Neoperl GmbH, Müllheim (DE)

( * ) Notice: Subject to any disclaimer, the term of this patent is extended or adjusted under 35 U.S.C. 154(b) by 343 days.

(21) Appl. No.: 16/641,392

(22) PCT Filed: Sep. 6, 2018

(86) PCT No.: PCT/EP2018/074066
§ 371 (c)(1),
(2) Date: Feb. 24, 2020

(87) PCT Pub. No.: WO2019/048576
PCT Pub. Date: Mar. 14, 2019

(65) Prior Publication Data

US 2020/0199857 A1 Jun. 25, 2020

(30) Foreign Application Priority Data

Sep. 6, 2017 (DE) ..... 202017105379.2

(51) Int. Cl.
*E03C 1/084* (2006.01)
*E03C 1/086* (2006.01)

(52) U.S. Cl.
CPC ..... *E03C 1/084* (2013.01); *E03C 1/086* (2013.01)

(58) Field of Classification Search
CPC ..... E03C 1/08; E03C 1/084; E03C 1/086
USPC ..... 239/428.5
See application file for complete search history.

(56) References Cited

U.S. PATENT DOCUMENTS

| | | | | |
|---|---|---|---|---|
| 8,708,252 | B2 * | 4/2014 | Blum | B05B 1/3026 239/580 |
| 9,963,860 | B2 | 5/2018 | Blum | |
| 2011/0240767 | A1 | 10/2011 | Kitaura et al. | |
| 2014/0053332 | A1 * | 2/2014 | Cole | E03C 1/046 4/678 |
| 2017/0009436 | A1 | 1/2017 | Schurle et al. | |
| 2017/0101768 | A1 | 4/2017 | Bosio | |
| 2017/0197223 | A1 * | 7/2017 | Otoguro | E03C 1/084 |

FOREIGN PATENT DOCUMENTS

| | | |
|---|---|---|
| CN | 102206946 | 10/2011 |
| CN | 202227407 | 5/2012 |
| CN | 205577033 | 9/2016 |
| CN | 106988383 | 7/2017 |
| EP | 2915927 | 9/2015 |
| EP | 3153633 | 4/2017 |
| WO | 2013162359 | 10/2013 |

* cited by examiner

*Primary Examiner* — Jason J Boeckmann
(74) *Attorney, Agent, or Firm* — Volpe Koenig

(57) ABSTRACT

A sanitary insert (1) in which the overall cross section of the aeration ducts (9, 18, 22, 23) of a jet aeration unit (3) is reduced by a ratio to the outer circumference of a mixing chamber (6) so that an air flow captures a leakage flow on the seal-free outer circumference of the insert (1) and transports the same into the mixing chamber (6).

14 Claims, 6 Drawing Sheets

JET REGULATOR

TECHNICAL FIELD

The invention relates to a sanitary insert, in particular a jet regulator, with a jet aeration unit that includes a mixing chamber, wherein the mixing chamber includes at least one aeration opening, wherein, outside the mixing chamber, at least one aeration duct feeding air from outside into the mixing chamber via the at least one aeration opening is formed.

The invention further relates to the use of an aeration duct, in particular on a sanitary insert of the type described above, which guides air via an aeration opening into a mixing chamber of a jet aeration unit of a sanitary insert, for capturing leakage flows by an attachment of the insert on a sanitary faucet.

BACKGROUND

Such sanitary inserts are, for example, known as jet regulators and are used in outlets of sanitary faucets in order to give a discharged water jet a desired characteristic, for example a particular cross-sectional shape or a particular enrichment in air content.

It has become standard in this regard to seal the insert vis-à-vis the receiving sanitary faucet by a washer so that water does not leak laterally between the insert and the sanitary faucet past the outer circumference of the insert.

It has been proposed to orient the aeration duct so that water trickling laterally past the insert is caught before it can escape. This makes it possible in certain conditions to omit the washer.

SUMMARY

The invention is based on the object of further developing an insert of the type described above so that the capture of trickling water is improved.

In order to achieve this object, a sanitary insert with one or more features in accordance with the invention is provided. In particular, it is thus provided for a sanitary insert of the type described above in accordance with the invention that the aeration duct includes two inlet openings that are separate from one another. It is advantageous here that a suction force, which is generated in the mixing chamber as the result of a negative pressure, can be used in order to capture undesired water at one of the two inlet openings, wherein a major portion of the air flow in the aeration duct can enter through the other inlet opening. The two functions of the aeration duct, namely, first, the transport of a sufficient quantity of air into the mixing chamber and, second, the capture and the transport into the mixing chamber of water that might otherwise leak at an undesired location, can thus be uncoupled from each other in a simple manner.

In an advantageous embodiment, it can be provided that at least two separate aeration ducts are formed so as to be adjacent in the circumferential direction. The total air flow can thus be separated in a simple manner into individual partial flows that can be regulated independently of one another in accordance with the particular requirements.

Generally, at least two, in particular at least three, separate aeration ducts, preferably aligned to be substantially parallel or parallel to one another, can be formed.

In an advantageous embodiment, it can be alternatively or additionally provided that the aeration duct extends over the outer circumference. An impairment of operation by individual clogged or dirty aeration ducts can thus be avoided or at least reduced. It can also be alternatively or additionally provided here that the aeration duct is connected to two aeration openings. This can help to achieve a desired stability of a wall of the mixing chamber, which is interspersed with the aeration openings.

In an advantageous embodiment, it can be provided that one of the inlet openings is arranged downstream from an outer thread formed on a housing of the insert. Trickling water that trickles through the outer thread in a mounted situation between the insert and a sanitary faucet, can thus be captured, for example along a trickle path, and discharged into the mixing chamber by this inlet opening. In the mixing chamber, the water can be united with a main jet. The inlet opening can be arranged here at the end of an internal thread. Water that flows in the internal thread can thus be captured completely or nearly completely. The inlet opening here can be arranged so as to partially cut into an axial area covered by the outer thread. Water can thus be captured at several points of an internal thread and/or from a plurality of internal threads of a multi-start outer thread. It can alternatively be provided that the inlet opening is formed so as to be completely outside the mentioned axial area. An embodiment can thus be achieved in which the screw characteristic of the outer thread is impacted to the smallest possible extent. The inlet opening can also be arranged downstream from a catch space, for example the catch space described in greater detail further below.

In an advantageous embodiment, it can be alternatively or additionally provided that one of the inlet openings opens laterally. Water can thus be captured from an outer circumference side of the insert.

In an advantageous embodiment, it can be provided that one of the inlet openings, for example the other inlet opening of the two inlet openings, is formed on an outlet face side of the insert. A main portion of suctioned air can thus be received in a manner that is as unimpeded as possible, because this inlet opening can be arranged as close as possible to the surroundings of the sanitary faucet.

In an advantageous embodiment, it can be alternatively or additionally provided that one of the inlet openings opens in a longitudinal direction of the insert. An embodiment can thus be achieved in which an increase of a total axial height of the insert by the inlet opening is avoidable.

In an advantageous embodiment, it can be provided that aeration ducts arranged so as to be evenly distributed in the circumferential direction are formed. An even utilization of the outlet face side of the insert for aeration can thus be achieved. A covering that is as even as possible of the outer circumference with inlet openings can also be achieved for the capture of trickling water. For example, it can be provided that the aeration ducts, in particular in relation to a longitudinal axis of the insert, are arranged symmetrically. An attractive appearance of the outlet front side can thus be achieved.

In an advantageous embodiment, it can be provided that aeration ducts arranged so as to be unevenly distributed in the circumferential direction are formed. For example, the aeration ducts can thus be concentrated in circumferential sections in which the risk of a leaking of trickling water is particularly high. For example, it can be provided that the aeration ducts, in particular in relation to a longitudinal axis of the insert, are arranged asymmetrically.

It can generally be provided that the respective aeration duct extends axially. In this case, the aeration opening and the at least one inlet opening can be arranged in a common circumferential section that can be taken up by the aeration opening and/or the at least one inlet opening. The aeration opening and the at least one inlet opening here can have a corresponding width in the circumferential direction. The aeration duct here can have a constant width in the circumferential direction along its course.

It can also be provided that both inlet openings of an aeration duct are arranged in a common circumferential section that can be taken up by an inlet opening or both inlet openings. It can be provided here as well that the aeration duct has a constant width in the circumferential direction along its course.

In order to achieve the stated object, the features directed to a sanitary insert are alternatively or additionally provided in accordance with the invention. In particular, for a sanitary insert with a jet aeration unit that includes a mixing chamber, wherein the mixing chamber includes at least one aeration opening, wherein, outside the mixing chamber, a first aeration duct feeding air from outside into the mixing chamber via the at least one aeration opening is formed, it is alternatively or additionally provided in accordance with the invention to arrange a second aeration duct directly adjacent to the first aeration duct in the circumferential direction at a first distance, to arrange a third aeration duct directly adjacent to the first aeration duct in the circumferential direction at a second distance, and to configure the first distance and/or the second distance so as to be greater than a width in the circumferential direction of the first, second and/or third aeration duct. An embodiment of the insert can thus be achieved in which unusually wide bridges are formed between the aeration ducts and thus between the aeration openings. By this, the available cross-sectional surface area of the aeration openings can be reduced in a simple manner in order to increase an air flow speed in the aeration ducts. It has been shown that an improved capture of trickling water can be achieved at an inlet opening by an increased air flow speed. The use of more than two aeration ducts has the advantage that the aeration ducts can be concentrated separately from one another at more than two locations. A cross-sectional surface area of the aeration ducts that cannot be used for a capture of trickling water can thus be avoided in order to achieve an air flow speed that is as high as possible. This solution can be combined advantageously with the preceding solution.

The term "directly adjacent" here can be characterized more precisely, for example, by specifying that, between two directly adjacent aeration ducts, no further aeration duct is arranged.

In order to achieve the stated object, the features directed to a sanitary insert are alternatively or additionally provided in accordance with the invention. In particular, for a sanitary insert with a jet aeration unit that includes a mixing chamber, wherein the mixing chamber includes at least one aeration opening, wherein, outside the mixing chamber, a first aeration duct guiding air from outside into the mixing chamber via the at least one aeration opening is formed, it is alternatively or additionally provided in accordance with the invention to arrange a second aeration duct directly adjacent to the first aeration duct in the circumferential direction at a first distance, to arrange a third aeration duct directly adjacent to the first aeration duct in the circumferential direction at a second distance, and to configure the first distance so as to be greater than the second distance. The above-described advantages of, first, a concentrated arrangement of a plurality of separate aeration ducts in a circumferential section and, second, the formation of circumferential sections that are free of aeration ducts, can thus be combined with one another. This solution can be combined advantageously with one or more than one of the preceding solutions.

The term "directly adjacent" can be characterized more precisely here as well, for example, by specifying that, between two directly adjacent aeration ducts, no further aeration duct is arranged.

In an advantageous embodiment, it can be provided that the second distance is configured so as to be greater than a width in the circumferential direction of the first aeration duct. A negative pressure that forms in the mixing chamber is thus particularly useful for the formation of an air flow speed that is as high as possible at those locations at which there is a risk of trickling water. It can in particular be provided that the second distance is configured so as to be at least twice as great as the width of the first aeration duct in the circumferential direction. In this way, a suitable ratio of open areas of a wall of the mixing chamber to a total circumference of the wall can be achieved in a simple manner.

In an advantageous embodiment, it can be provided that the first distance is configured so as to be smaller than a width in the circumferential direction of the first aeration duct. Separate aeration ducts can thus be arranged at the desired locations particularly close to one another. It can in particular be provided that the first distance is configured so as to be at most half as great as the width of the first aeration duct in the circumferential direction.

In an advantageous embodiment, it can be provided that the mixing chamber is closed to the outside between the aeration ducts. The entry of additional suctioned air, which would reduce an air flow speed in the aeration ducts, is thus avoidable.

In an advantageous embodiment, it can be provided that two aeration ducts adjacent in the circumferential direction are separated from one another by a dividing wall. Adjacent aeration ducts can thus be uncoupled from one another in a simple manner.

In an advantageous embodiment, it can be provided that a width, for example the width already mentioned, in the circumferential direction of a first aeration duct, for example of the first aeration duct already mentioned, is aligned with a width of a lateral open inlet opening, for example the lateral open inlet opening already mentioned. A maximum air flow speed can thus be selected at a level of the inlet opening. It is particularly beneficial when this applies to all aeration ducts.

In order to achieve the stated object, the features directed to a sanitary insert can be alternatively or additionally provided in accordance with the invention. In particular, for a sanitary insert with a jet aeration unit which includes a mixing chamber, wherein the mixing chamber includes at least one aeration opening, wherein, outside the mixing chamber, at least one aeration duct feeding air from outside into the mixing chamber via the at least one aeration opening is formed, it can thus be alternatively or additionally provided in accordance with the invention that a ratio of a sum of lengths covered by aeration ducts in the circumferential direction to a total length of an outer circumference of the mixing chamber, measured at the level of said one of the two inlet openings, is at most 60%. It has been shown that, by this measure, expedient air flow speeds can already be reached. For example, the sum of the lengths is at most 50%, at most 40% or especially preferably at most 35% or even at most 33% of the total length. It can generally be said that a higher air flow speed is conducive to a better capture of trickling water and that a decreased ratio is better for a higher air flow speed. The particular lengths can be measured here, for example at a level of one of the two inlet openings, in particular of the lateral inlet opening.

In an advantageous embodiment here, at least three aeration ducts can be formed.

Alternatively or additionally, two inlet windows can be formed per aeration duct here.

Alternatively or additionally, the aeration ducts can be formed so as to be higher (in the radial direction) than wide (in the circumferential direction).

In an advantageous embodiment, it can be provided that a jet splitter forming at least one nozzle is arranged upstream of the mixing chamber. A negative pressure can thus be generated in a simple manner in the mixing chamber, which results from the working pressure of the water on the inflow side.

In an advantageous embodiment, it can be provided that a flow regulator is arranged upstream of the mixing chamber. Defined pressure ratios can thus be achieved in the mixing chamber independently or as independently as possible of fluctuations in the working pressure on the inflow side.

In an advantageous embodiment, it can be provided that an outlet screen is arranged downstream of the mixing chamber. An attractive jet pattern can thus be achieved. The portion of air suctioned through the outlet opening can be reduced.

In an advantageous embodiment, it can be provided that a laterally open inlet opening, for example the laterally open inlet opening already mentioned, of the aeration duct is connected to a catch space that is at least closed to the outside in a position of use. Trickling water can thus be, for example, collected over the entire circumference and discharged via narrow inlet openings into aeration ducts. The catch space can be formed so as to be closed beyond the inlet opening so that only a small portion of air enters via this inlet opening during operation and the inlet opening functions substantially or even exclusively in the manner of an overflow.

In an advantageous embodiment, it can be provided that the at least one aeration duct is configured so as to be closed to the outside on a circumference side of the insert. The flow conditions in the aeration duct can thus be formed independently of an embodiment of a receiving sanitary faucet.

In order to achieve the stated object, the features of the fourth dependent claim directed to a sanitary insert are alternatively or additionally provided in accordance with the invention. In particular, for a sanitary insert with a jet aeration unit which includes a mixing chamber, wherein the mixing chamber includes at least one aeration opening, wherein, outside the mixing chamber, at least one aeration duct guiding air from outside into the mixing chamber via the at least one aeration opening is formed, it is alternatively or additionally provided in accordance with the invention that the aeration duct have a cross section that is dimensioned so that, in the event of a water working pressure on the inflow side between 1 to 2 bar, an air flow speed of at least 15 km/h occurs in the aeration duct. For example, the air flow speed can be measured here at the level of a laterally open inlet window, in particular, for example, the laterally open inlet window already mentioned. It has been shown that particularly favourable conditions for a capture of trickling water in the air flow that is as complete as possible can be achieved above the stated threshold for the air flow speed. This solution can be combined advantageously with one or more of the preceding solutions.

It is particularly beneficial when the air flow speed is at least 17 km/h. Generally, it can be said that a higher air flow speed yields a better capture of water at an inlet opening.

In an advantageous embodiment, it can be provided that at least one trickle path empties into the aeration duct, the trickle path running via an outer thread on the insert on the outer circumference side. A sealing at the outer thread can thus be omitted or at least reduced with respect to its sealing effect. Such a trickle path can be, for example, formed in a random fashion or run through at least one internal thread.

In order to achieve the stated object, the features of the dependent claim directed to the use of an aeration duct are alternatively or additionally provided in accordance with the invention. In particular, it is thus provided in accordance with the invention for the use of an aeration duct of the type described above that a ratio of a sum of lengths covered in the circumferential direction by aeration ducts, in particular at a level of at least one inlet opening capturing the leakage flow, to a total length of an outer circumference of the mixing chamber at that level is at most 60%. It has been shown that sufficiently high air flow speeds can already be achieved with a ratio below the indicated threshold. It is particularly beneficial when an insert in accordance with the invention used here, in particular as described above and/or in accordance with one of the claims directed to an insert, is used.

For example, it can be provided that the ratio is at most 50% or at most 40% or at most 35% or at most 33%. Ever higher air flow speeds can be achieved in the aeration ducts this way.

BRIEF DESCRIPTION OF THE DRAWINGS

The invention will now be described with the help of an example embodiment in greater detail, but is not limited to this example embodiment. Further example embodiments result from a combination of the features of individual or a plurality of claims with one another and/or with individual or a plurality of features of the example embodiment.

The figures show.

DETAILED DESCRIPTION

Figure 1:
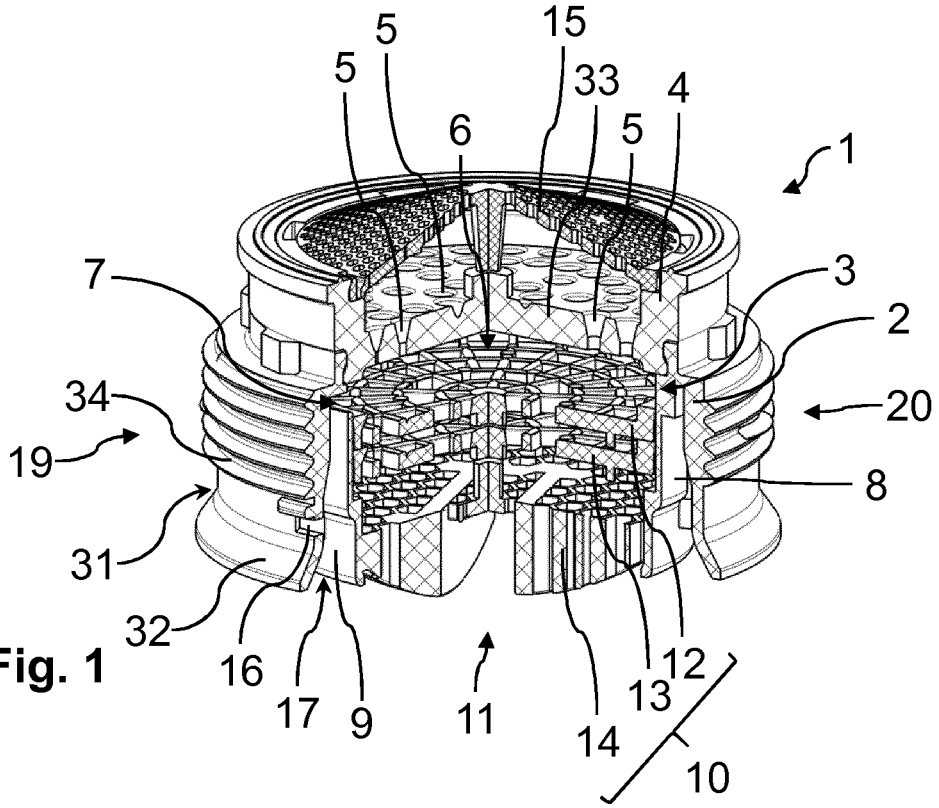
FIG. 1 a sanitary insert in accordance with the invention in a partially sectional, three-dimensional perspective view, FIG. 2 the insert of FIG. 1 in a view of the outlet face side from below, FIG. 3 the insert of FIG. 1 with the inner parts and sediment sieve removed in a partially sectional, three-dimensional perspective view, FIG. 4 a view of the insert of FIG. 1 for illustrating the position of the section in FIG. 3, FIG. 5 the insert of FIG. 1 with the inner parts and sediment sieve removed in a further partially sectional, three-dimensional perspective view, FIG. 6 a view of the insert of FIG. 1 for illustrating the position of the section in FIG. 3, FIG. 7 the insert of FIG. 1 with the inner parts and sediment sieve removed and jet splitter in a further partially sectional, three-dimensional perspective view, FIG. 8 two views of the insert for illustrating the position of the section in FIG. 7, FIG. 9 the insert of FIG. 1 with the inner parts and sediment sieve removed in a further partially sectional, three-dimensional perspective view, FIG. 10 two views of the insert for illustrating the position of the section in FIG. 7, FIG. 11 the insert of FIG. 1 with the inner parts and sediment sieve removed in a further partially sectional, three-dimensional oblique view, and FIG. 12 two views of the insert for illustrating the position of the section in FIG. 11.

The figures are described in the following together.

A sanitary insert designated as a whole by 1 has in a known manner a housing 2, in which a jet aeration unit 3 is formed. The jet aeration unit 3 has a jet splitter 4, which includes nozzles 5. In the example embodiment, the jet splitter 4 includes a perforated plate 33, which provides the nozzles 5. In other example embodiments, the jet splitter has a diffuser with a diffuser ring known per se, which provides a ring nozzle.

A mixing chamber 6 is arranged downstream of the jet splitter 4. The water exiting through the nozzles 5 creates a negative pressure in the mixing chamber 6 by which air enters via aeration openings 7 formed in a wall 8 of the mixing chamber 6.

At least one aeration duct 9 is formed outside the mixing chamber 6. Each aeration duct 9 is connected to a corresponding aeration opening 7.

Each aeration duct 9 thus feeds air from outside via a corresponding aeration opening 7 into the mixing chamber 6. There, the introduced air mixes with the water exiting the nozzles 5 in order to create a water-air mixture.

Arranged downstream from the mixing chamber 6 is a plurality of jet formers 10 by which the aerated jet is shaped before it leaves the outlet face side 11.

In the example embodiment, the jet former 10 is formed by two insert screens 12, 13 and an aligning outlet screen 14. In other example embodiments, other quantities and shapes of inner parts and outlet structures are realized.

In the example embodiment shown, a sediment sieve 15 covers the jet splitter 4 on the inflow side.

In other example embodiments, a flow regulator or a throttle or a further functional element can be arranged between the sediment sieve 15 and the jet splitter 4.

Figure 9:
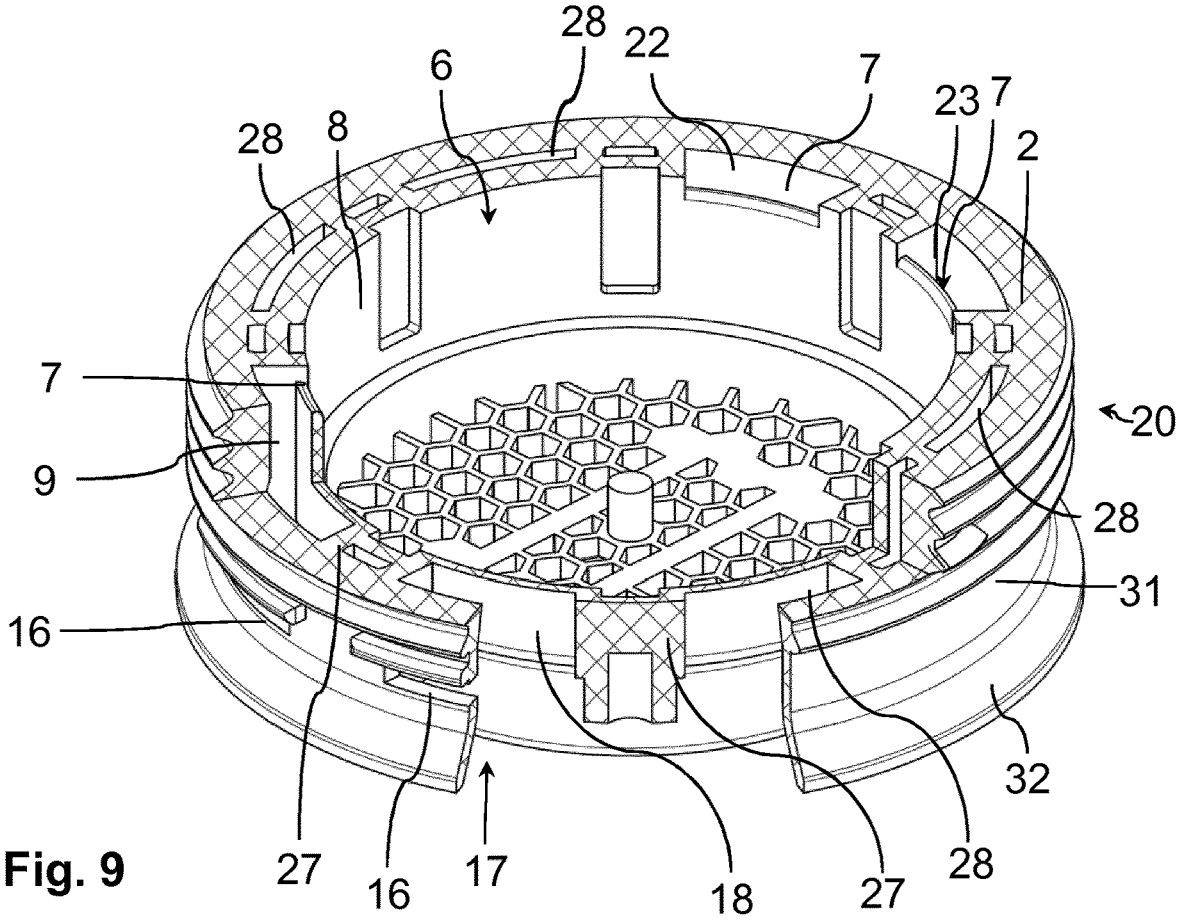
Figure 10:
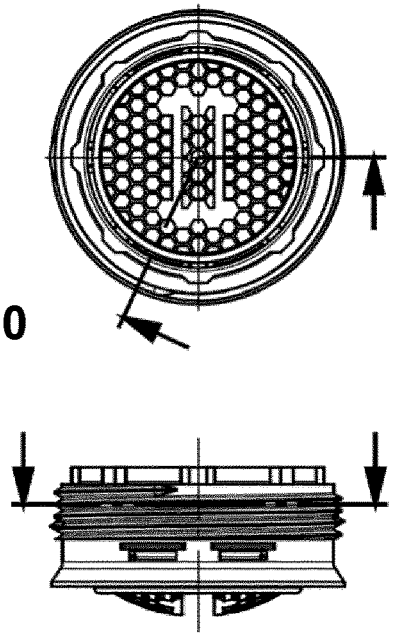
Figure 11:
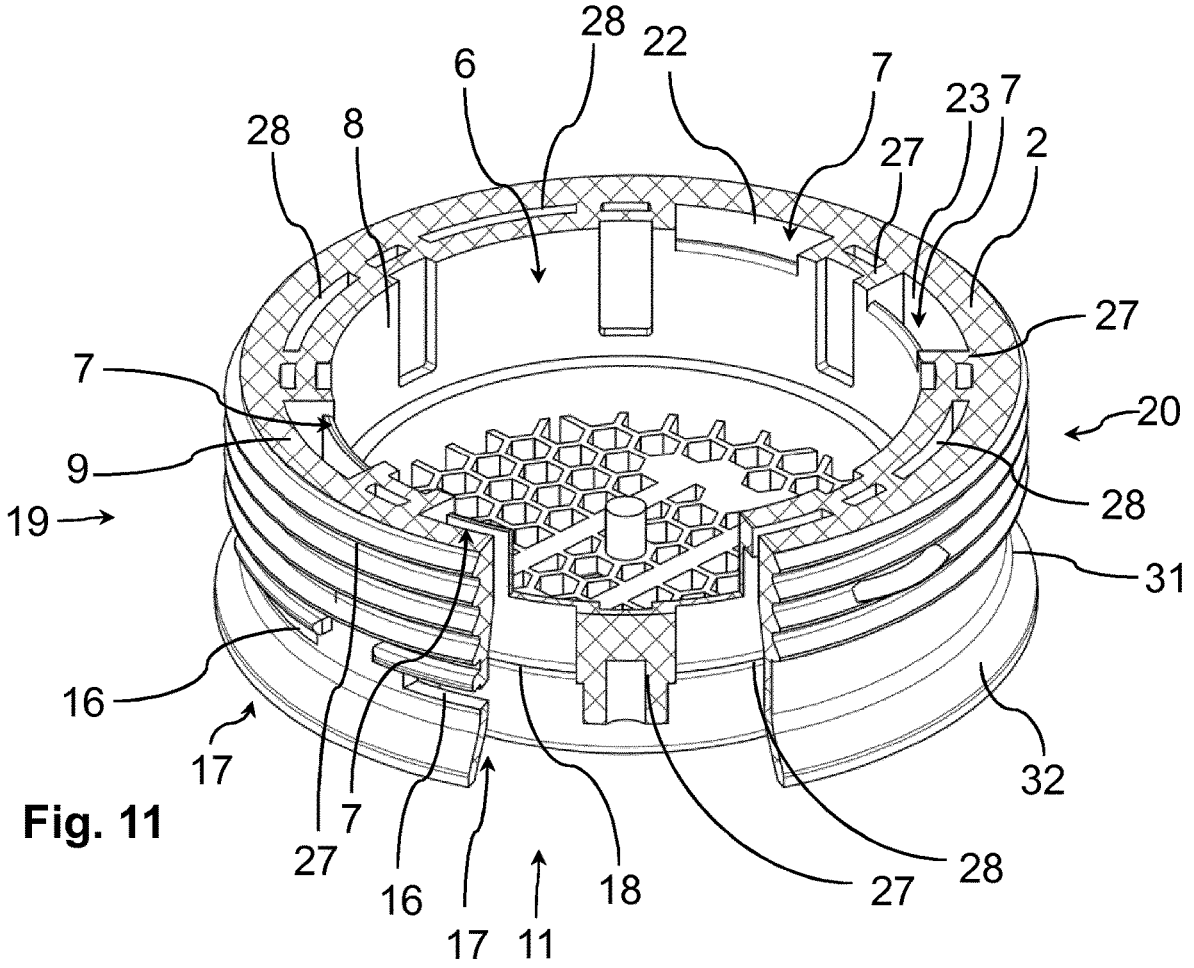
Figure 12:
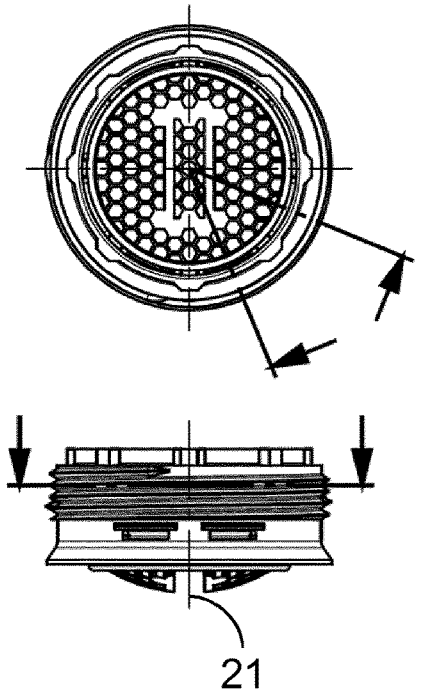

It is apparent in particular in FIG. 9 that each aeration duct 9 includes two inlet openings 16, 17 that are separate from one another. A Y-shaped topology of the aeration duct 9 is thus created, which brings the inlet openings 16, 17 together and leads to the corresponding aeration opening 7.

The main flow of the aeration duct 9 is sucked in here through the axial inlet opening 17, while only a small portion of air enters the aeration duct 9 through the lateral inlet opening 16 during use.

Figure 3:
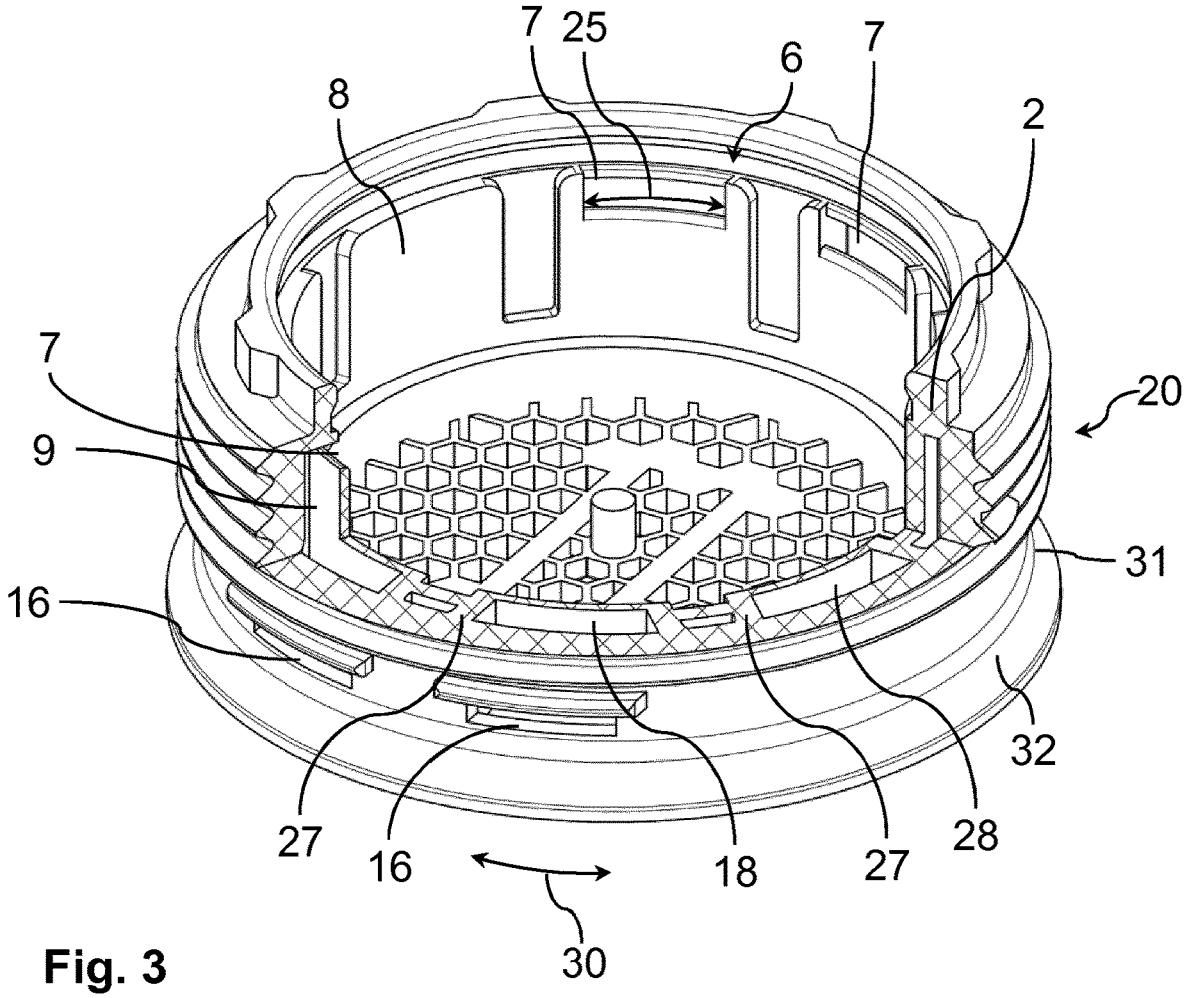
Figure 4:
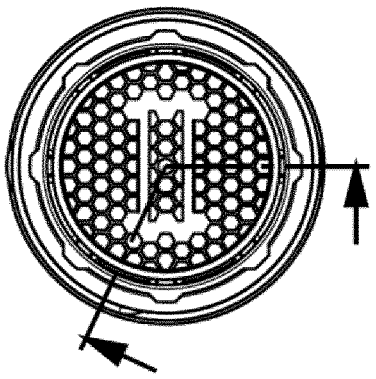
Figure 5:
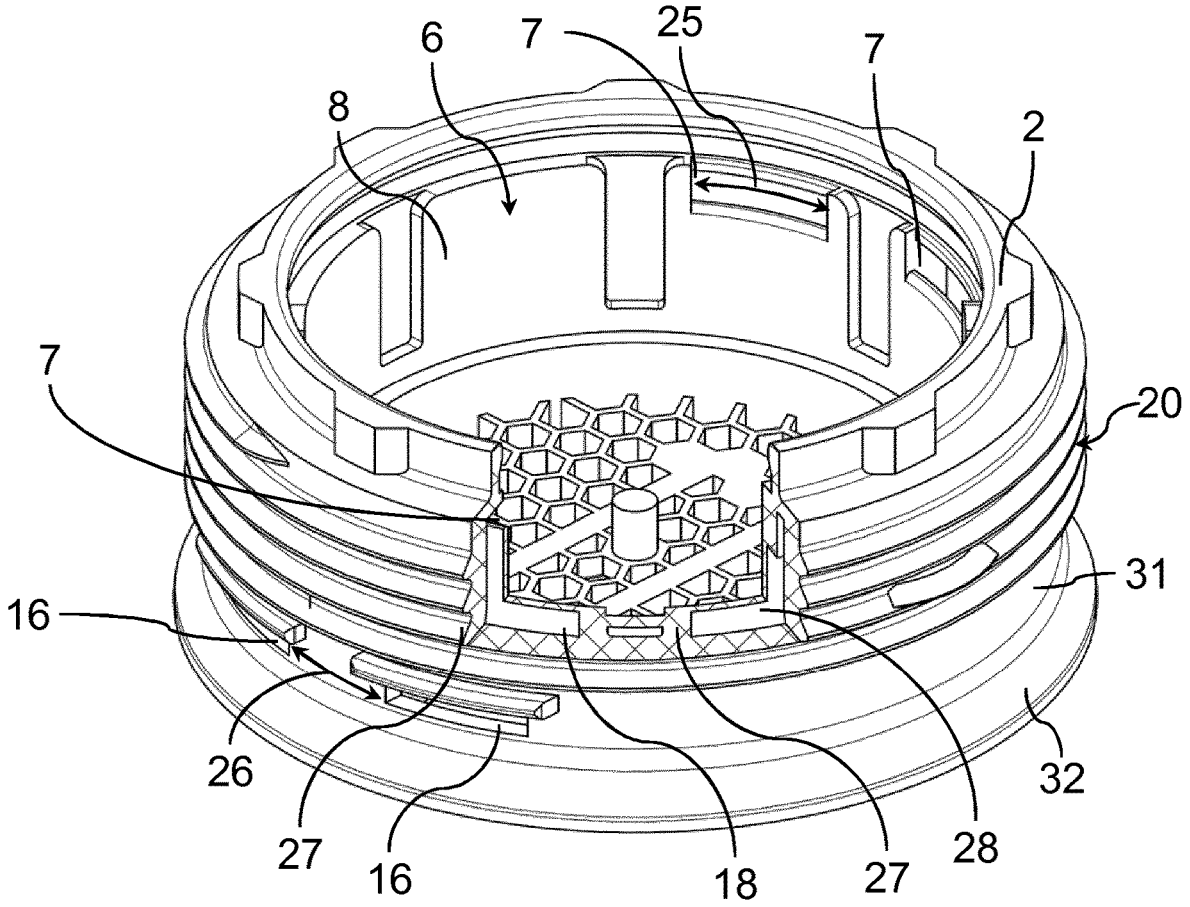
Figure 6:
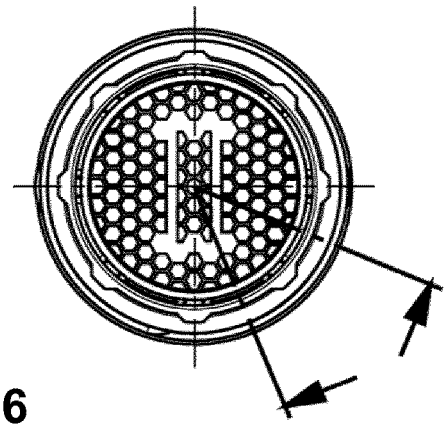
Figure 7:
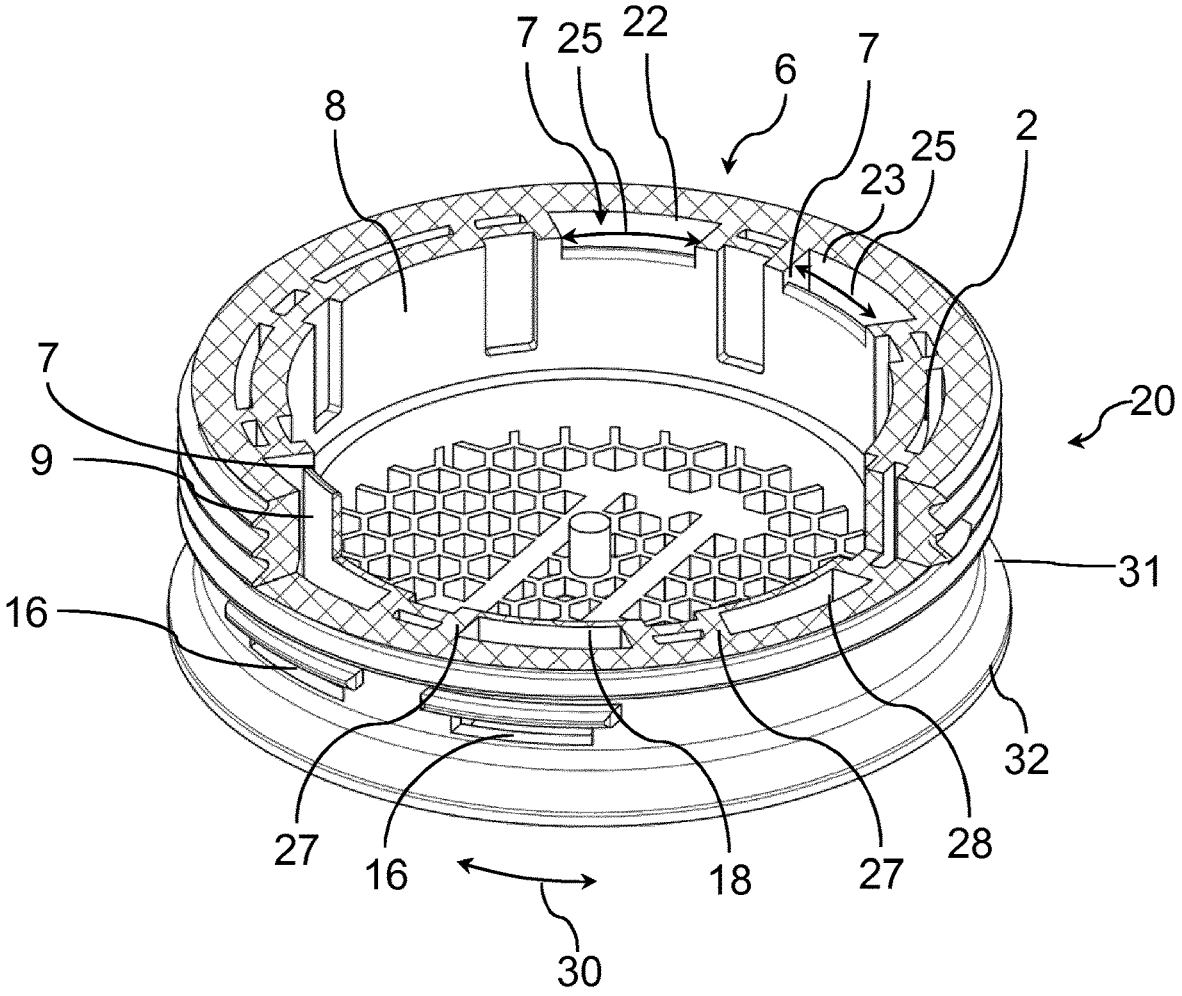
Figure 8:
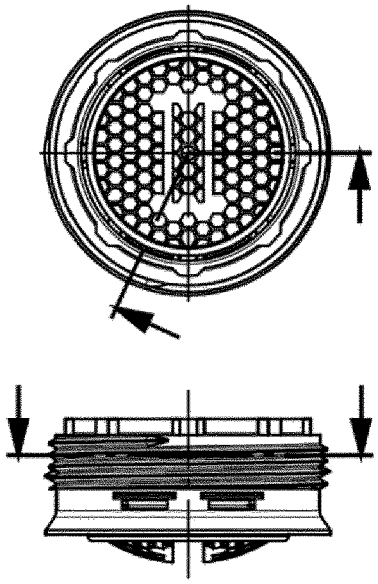

By a comparison of FIGS. 3 and 5, it is apparent that at least two aeration ducts 9, 18 that are separate from one another are formed next to one another in the circumferential direction.

An outer thread 20 is formed in the housing 2 on an outer circumference side 19 of the insert 1. By the outer thread 20, the insert 1 can be screwed into an outlet of a sanitary faucet. In a further example embodiment, the outer thread is formed on a holding sleeve of a housing 2 that is itself not threaded.

One of the inlet openings 16 is arranged downstream from the outer thread 20 and opens laterally.

The other inlet opening 17 of the two inlet openings 16, 17 is formed on the outlet face side 11 of the insert 1 and opens in a longitudinal direction 21 of the insert 1.

The in total four aeration ducts 9, 18, 22, 23 are arranged so as to be distributed unevenly in the circumferential direction.

The aeration duct 9 can be considered as the first aeration duct, the aeration duct 22 as the second aeration duct, the aeration duct 18 as the third aeration duct and the aeration duct 23 as the fourth aeration duct.

The second aeration duct 22 is directly adjacent to the first aeration duct 9 in the circumferential direction. The third aeration duct 18 is also directly adjacent to the first aeration duct 9 in the circumferential direction.

A first distance 24 in the circumferential direction (measured, for example, as an angle or an arc length) between the first aeration duct 9 and the second aeration duct 22 is more than twice as great as a width 25 in the circumferential direction of the aeration opening 7 here. The corresponding second distance 26 between the first aeration duct 9 and the third aeration duct 18, on the other hand, is less than half as great as the width 25 and thus clearly smaller than the first distance 24.

Overall, an arrangement of aeration ducts 9, 18, 22, 23 results that has the symmetry of two intersecting mirror planes.

The mixing chamber 6 is closed off to at its outer circumference between the aeration ducts 9, 18, 22, 23. The adjacent aeration ducts 9, 18 are separated from one another by a dividing wall 27.

Figure 2:
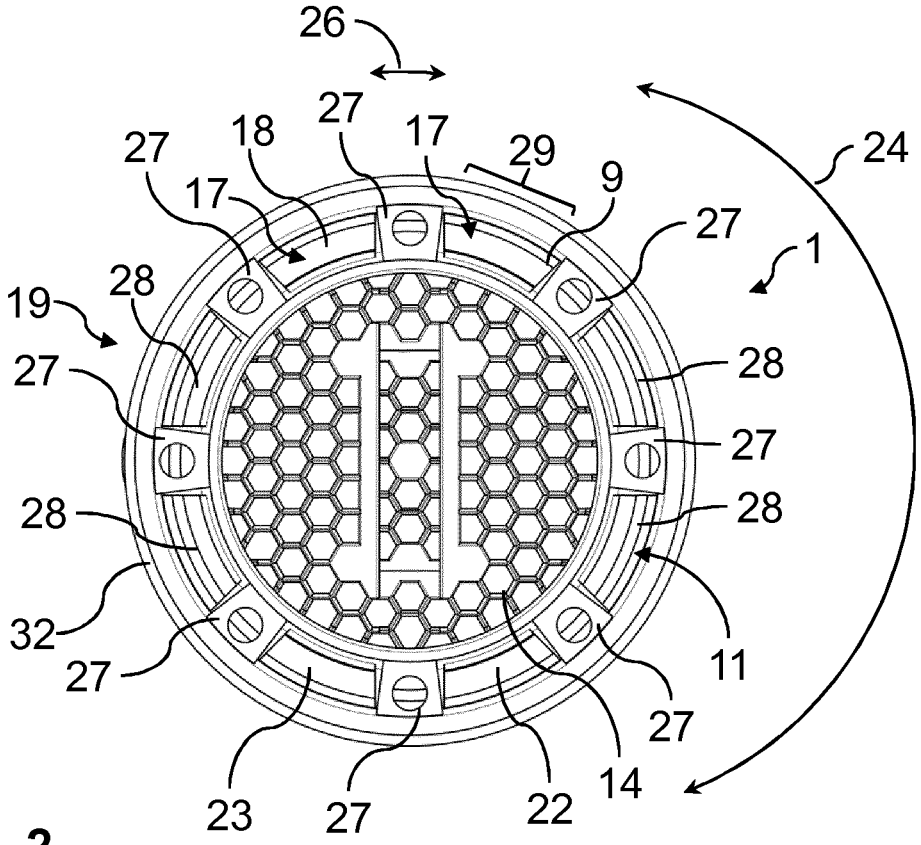

Two blind ducts 28 are respectively formed between the aeration ducts 9 and 22 on one side and 18 and 23 on the other, which, although open on the outlet face side 11, are otherwise formed so as to be closed. An extremely symmetrical arrangement is thus achieved on the outlet face side 11, cf. FIG. 2.

The aeration ducts 9, 18, 22, 23 respectively have a uniform width 29 in the circumferential direction along their course. This width 29 in the circumferential direction is aligned with a width 30 of the laterally open inlet opening 16.

A ratio of a sum of the lengths (for example, as an angle or arc length), which are covered at a level of the inlet openings 16 by the four aeration ducts 9, 18, 22, 23, to the total length of the outer circumference of the mixing chamber 6 (measured, for example, externally on the wall 8), also measured at the level of the inlet openings 16, is approximately 31%.

Adjoining the wall 8 of the housing 2 on the side of its outer circumference is a catch space 31, which, in a position of use, is closed off to the outside from a sanitary faucet by a sealing element 32 here a circumferential lip seal.

Each laterally open inlet opening 16 of each aeration duct 9, 18, 22, 23 is connected to the catch space 31 so that water trickling through the outer thread 20 can exit from the respective inlet opening 16 into the corresponding aeration duct 9, 18, 22, 23.

Each of the aeration ducts 9, 18, 22, 23 is formed so as to be closed off to the outside on a circumference side of the insert 1.

Each aeration duct 9, 18, 22, 23 has a cross section that is dimensioned so that, in the event of a water working pressure on the inflow side before the jet splitter 4 between 1 to 2 bar or in the event of a loss in pressure of 1 to 2 bar above the jet splitter 4, an air flow speed of at least 17 km/h occurs in each aeration duct 9, 18, 22, 23 at the level of the laterally open inlet window 16.

The water exiting from the first inlet openings 16 into the respective aeration duct 9, 18, 22, 23 can thus be captured and transported into the mixing chamber 6. There, the entrained water mixes with the water flowing from the nozzles 5.

Each internal thread of the outer thread 20 forms a trickle path 34, through which water can trickle from the inflow side during use, as no washer is provided. This water is captured in the catch space 31 and fed through the first inlet openings 16 and the aeration ducts 9, 18, 22, 23 to the mixing chamber 6 so that no leaking water on the side of the insert 1 can exit the sanitary faucet during use.

The example embodiment thus realizes in the operational position a use of an aeration duct 9, 18, 22, 23 on a sanitary insert 1, which leads via an aeration opening 7 into a mixing chamber 6 of a jet aeration unit 3 of the sanitary insert 1, for capturing leakage flows by an attachment of the insert 1 on a sanitary faucet.

The above-described ratio of a sum of all lengths covered by all aeration ducts 9, 18, 22, 23 in the circumferential direction at a level of the inlet openings 16 capturing the leakage flow to a total length of an outer circumference of the mixing chamber 6 at that level is approximately 31% here.

It is thus provided that for an insert 1 in accordance with the invention that the overall cross section of the aeration ducts 9, 18, 22, 23 of a jet aeration unit 3 is reduced by a ratio to the outer circumference of a mixing chamber 6 so that an air flow captures a leakage flow on the seal-free outer circumference of the insert 1 and transports the same into the mixing chamber 6.

LIST OF REFERENCES

1 Sanitary insert
2 Housing
3 Jet aeration unit
4 Jet splitter
5 Nozzle
6 Mixing chamber
7 Aeration opening
8 Wall
9 (First) aeration duct
10 Jet former
11 Outlet face side
12 Insert screen
13 Insert screen
14 Outlet screen
15 Sediment sieve
16 Inlet opening
17 Inlet opening
18 (Third) aeration duct
19 Outer circumference side
20 Outer thread
21 Longitudinal direction
22 (Second) aeration duct
23 (Fourth) aeration duct
24 (First) distance
25 Width of 7
26 (Second) distance
27 Dividing wall
28 Blind duct
29 Width of 9, 18, 22, 23
30 Width of 16
31 Catch space
32 Sealing element
33 Perforated plate
34 Trickle path

The invention claimed is:

1. A sanitary insert (1), comprising:

a housing (2);

a jet aeration unit (3), which includes;

a mixing chamber (6), the mixing chamber (6) includes at least first and second spaced apart aeration openings (7), at least first and second aeration ducts (9, 18, 22, 23) formed outside the mixing chamber (6), the at least first and second ducts (9, 18, 22, 23) configured to feed air from outside into the mixing chamber (6) via respective ones of the at least first and second aeration openings (7), and the at least first and second aeration ducts (9, 18, 22, 23) each have two inlet openings (16, 17) that are separate from one another, and one of the inlet openings (16, 17) opens laterally and one of the inlet openings (16, 17) opens in a longitudinal direction (21) of the insert, wherein the inlet opening (16) that opens laterally is arranged downstream from an outer thread (20) formed on an outer circumference of the housing (2), the at least first and second aeration ducts are formed so as to be adjacent in a circumferential direction, each connecting to one of the aeration openings, wherein the at least first and second aeration ducts adjacent in the circumferential direction are separated by a dividing wall (27) from one another to provide separate aeration paths to the respective at least first and second aeration openings (7).

2. The sanitary insert (1) as claimed in claim 1, further comprising an outlet face side (11), wherein one of the inlet openings (16, 17) is formed on the outlet face side (11) of the insert.

3. The sanitary insert (1) as claimed in claim 1, wherein the at least one aeration duct comprises a plurality of aeration ducts (9, 18, 22, 23) that are arranged so as to be evenly distributed in a circumferential direction.

4. A sanitary insert (1), comprising:

a jet aeration unit (3), which includes a mixing chamber (6), the mixing chamber (6) includes at least one aeration opening (7), a first aeration duct formed outside the mixing chamber (6), at a downstream outlet face side of the sanitary insert, the first aeration duct feeding air from outside to the mixing chamber (6) via the at least one aeration opening (7), a second aeration duct (22) arranged directly adjacent to the first aeration duct (9) in a first circumferential direction at a first distance (24), a third aeration duct (18) arranged directly adjacent to the first aeration duct (9) in a second circumferential direction, opposite to the first circumferential direction, at a second distance (26), each of the first, second, and third aeration ducts (9, 22, 18) includes two inlet openings (16, 17) that are separate from one another, wherein at least one of the first distance (24) or the second distance (26) is greater than a width in the circumferential direction of at least one of the first, second or third aeration duct (18), and wherein two of the aeration ducts adjacent in the circumferential direction are separated from one another by a dividing wall (27).

5. A sanitary insert (1), comprising:

a jet aeration unit (3), which includes a mixing chamber (6), the mixing chamber (6) includes at least one aeration opening (7), a first aeration duct formed outside the mixing chamber (6), at a downstream outlet face side of the sanitary insert, the first aeration duct guiding air from outside to the mixing chamber (6) via the at least one aeration opening (7), a second aeration duct (22) arranged directly adjacent to the first aeration duct (9) in a first circumferential direction at a first distance (24), the second aeration duct guiding air from outside to the mixing chamber via the at least one aeration opening, a third aeration duct (18) arranged directly adjacent to the first aeration duct (9) in a second circumferential direction, opposite to the first circumferential direction, at a second distance (26), the third aeration duct guiding air from outside to the mixing chamber via the at least one aeration opening, each of the first, second and third aeration ducts (9, 22, 18) includes two inlet openings (16, 17) that are separate from one another, wherein the first distance (24) is greater than the second distance (26), and wherein two of the aeration ducts adjacent in the circumferential direction are separated from one another by a dividing wall (27).

6. The sanitary insert (1) as claimed in claim 5, wherein the second distance (26) is greater than a width in the circumferential direction of the first aeration duct (9).

7. The sanitary insert (1) as claimed in claim 5, wherein the first distance (24) is smaller than a width in the circumferential direction of the first aeration duct (9).

8. The sanitary insert (1) as claimed in claim 5, wherein the mixing chamber (6) is closed to the outside between the aeration ducts.

9. The sanitary insert (1) as claimed in claim 5, wherein at least one of the aeration ducts has a lateral inlet opening, and a width in the circumferential direction of the first aeration duct (9) is aligned with a width of the lateral open inlet opening.

10. A sanitary insert (1), comprising:

a housing (2) having an outer thread (20) thereon;

a jet aeration unit (3) housed therein, which includes a mixing chamber (6), the mixing chamber (6) includes at least one aeration opening (7), at least first and second aeration ducts (9, 18, 22, 23) formed outside the mixing chamber (6), the at least first and second aeration ducts (9, 18, 22, 23) feeding air from outside to the mixing chamber (6) via the at least one aeration opening (7), the at least first and second aeration ducts (9, 18, 22, 23) each have two inlet openings (16, 17) that are separate from one another, a ratio of a sum of lengths covered by all of the aeration ducts (9, 18, 22, 23) in the circumferential direction measured at a level of one of the two inlet openings (16, 17), to a total length of an outer circumference of the mixing chamber (6), measured at the level of said one of the two inlet openings (16, 17), is at most 60%, wherein the housing (2) on an outer circumference thereof comprises a catch space (31), which, in a position of use, is closed off to the outside from a sanitary faucet by a circumferential lip seal (32), wherein the at least first and second aeration ducts adjacent in the circumferential direction are separated by a dividing wall (27).

11. The sanitary insert (1) as claimed in claim 10, further comprising a jet splitter (4) forming at least one nozzle (5) arranged upstream of the mixing chamber (6).

12. The sanitary insert (1) as claimed in claim 10, further comprising at least one of a flow regulator arranged upstream of the mixing chamber (6) or an outlet screen arranged downstream of the mixing chamber (6).

13. The Sanitary insert (1) of claim 10, wherein at least one of the inlet openings (16) opens laterally, with regard to a direction of flow, and is formed in the catch space (31).

14. A sanitary insert (1), comprising:

a housing (2) having an outer thread (20) thereon;

a jet aeration unit (3) housed therein, which includes a mixing chamber (6), the mixing chamber (6) includes at least one aeration opening (7), at least first and second aeration ducts (9, 18, 22, 23) formed longitudinally within a circumferentially extending wall of the housing (2), outside the mixing chamber (6), the at least first and second aeration ducts (9, 18, 22, 23) guiding air from outside into the mixing chamber (6) via the at least one aeration opening (7), and at least first and second inlet openings (16), formed laterally in an outer wall of the housing (2), and in communication with respective ones of the at least first and second aeration ducts (9, 18, 22, 23);

wherein each of the at least first and second aeration ducts (9, 18, 22, 23) has a cross section that is dimensioned so that, in the event of a water working pressure on an inflow side between 1 to 2 bar, an air flow speed of at least 15 km/h occurs in the aeration duct, and, wherein the first and second aeration ducts are adjacent to one another in the circumferential direction and separated by a dividing wall (27) such that the first and second inlet openings are only in communication with the respective first or second aeration ducts.

* * * * *